US009483977B2

(12) United States Patent
Hyeon

(10) Patent No.: US 9,483,977 B2
(45) Date of Patent: Nov. 1, 2016

(54) LIGHT EMITTING DISPLAY DEVICE AND DRIVING METHOD THEREOF

(75) Inventor: Chang Ho Hyeon, Yongin-si (KR)

(73) Assignee: LG Display Co., Ltd., Seoul (KR)

( * ) Notice: Subject to any disclaimer, the term of this patent is extended or adjusted under 35 U.S.C. 154(b) by 867 days.

(21) Appl. No.: 11/723,210

(22) Filed: Mar. 19, 2007

(65) Prior Publication Data

US 2008/0231565 A1 Sep. 25, 2008

(51) Int. Cl.

| | |
|---|---|
| ***G09G 3/32*** | (2016.01) |
| ***G09G 3/20*** | (2006.01) |
| ***G09G 5/393*** | (2006.01) |
| ***G09G 5/399*** | (2006.01) |

(52) U.S. Cl.

CPC ..... *G09G 3/3233* (2013.01); *G09G 3/2022* (2013.01); *G09G 3/2074* (2013.01); *G09G 3/3225* (2013.01); *G09G 5/393* (2013.01); *G09G 5/399* (2013.01); *G09G 3/2044* (2013.01); *G09G 2300/0842* (2013.01); *G09G 2320/0247* (2013.01); *G09G 2320/0261* (2013.01); *G09G 2320/0266* (2013.01); *G09G 2320/103* (2013.01)

(58) Field of Classification Search

CPC ..... G09G 3/2022; G09G 3/2044; G09G 3/3225; G09G 3/3233; G09G 3/2074; G09G 5/393; G09G 5/399; G09G 2300/0842; G09G 2320/103; G09G 2320/0247; G09G 2320/0261; G09G 2320/0266

USPC ..... 345/536, 539, 540; 365/226–229

See application file for complete search history.

(56) References Cited

U.S. PATENT DOCUMENTS

| | | | | |
|---|---|---|---|---|
| 6,380,672 | B1 * | 4/2002 | Yudasaka | 313/504 |
| 2004/0090404 | A1 * | 5/2004 | Endo et al. | 345/82 |
| 2004/0257328 | A1 * | 12/2004 | Lim | 345/100 |
| 2005/0001857 | A1 * | 1/2005 | Nakakita et al. | 345/690 |
| 2005/0068288 | A1 * | 3/2005 | Jang et al. | 345/100 |
| 2006/0033445 | A1 * | 2/2006 | Kim et al. | 315/169.3 |
| 2006/0262054 | A1 * | 11/2006 | Yamazaki et al. | 345/77 |
| 2008/0231565 | A1 * | 9/2008 | Hyeon | 345/82 |

* cited by examiner

*Primary Examiner* — David Tung

(74) *Attorney, Agent, or Firm* — Morgan, Lewis & Bockius LLP

(57) ABSTRACT

A method of driving an organic light emitting display device includes: receiving an image signal by sub-field with respect to a single frame comprising the N number of sub-fields (N is a natural number greater than 2) from the exterior; dividing a single sub-field into an address period and a display period and selectively calling a data signal of a single sub-field from the M number of sub-field memories (M is a natural number greater than 2); and applying the called data signal of the single sub-field to a sub-pixel.

20 Claims, 6 Drawing Sheets

LIGHT EMITTING DISPLAY DEVICE AND DRIVING METHOD THEREOF

BACKGROUND

1. Field

This document relates to a light emitting display device and its driving method.

2. Related Art

In general, a light emitting display device is a self-emission type display device that emits light by electrically exciting fluorescent compounds, and with its advantages that it may be driven at a low voltage, may be easily formed to be thin and has a wide viewing angle and fast response speed, the light emitting display device receives much attention as a next-generation display device which may overcome the drawbacks of the liquid crystal display.

An organic light emitting display device comprises an organic luminescence layer between an anode and a cathode in which holes provided from the anode and electrons received from the cathode are combined to form exciton, namely, a pair of hole-electron, and the organic light emitting display device emits light by energy generated as the exciton returns to its bottom state. The organic light emitting display device may comprise a hole (electron) transport layer and/or hole (electron) injection layer between the anode or the cathode and the light emission layer.

The organic light emitting display device may be divided into a passive matrix type organic light emitting display device and an active matrix type organic light emitting display device according to a driving method.

FIG. 1 shows a frame structure of the related art digitally driven organic light emitting display device.

Referring to FIG. 1, one frame of a sub-pixel is divided into six sub-fields, namely, first to six sub-fields (SF1 to SF6), to indicate (display) 6 bits. In this case, respective sub-fields SF1 to SF6 comprise an address period and a display period.

The address period is the same at every sub-field and refers to a period during which a data signal is applied to a sub-pixel selected by a scan signal and stored in a capacitor of the sub-pixel. During the address period, the data signal is stored in the capacitor and also an organic light emitting diode (OLED) is illuminated.

The display period is a period during which illuminating of the OLED is maintained by using the data signal stored in the capacitor Cst until a next data signal is applied. The display period has a binary weight. Namely, illumination periods of the respective sub-fields are SF2=2*SF1, SF3=4*SF1, SF4=8*SF1, SF5=16*SF1, and SF6=32*SF1. Accordingly, the display period lengthens as it goes up to the relatively higher gray levels, and shortens as it goes down to the relatively lower gray levels.

In the organic light emitting display device that comprises the plurality of sub-pixels, in a state that scan signals (scan signals 1, 2, 3, and 4, . . . ) are applied through scan lines to the sub-pixels during the address period, data signals are inputted through the data lines. Then, upon receiving the data signals, the sub-pixels maintain their luminous state during the display period until the next data signal is applied.

As described Referring to FIG. 1, in the case where a single frame comprises six sub-fields and the display period has the binary weight, gray levels of respective sub-pixels are represented according to combinations of display time of the six sub-fields.

However, in the related art organic light emitting display device, a minimum display time corresponds to duration from when a first scan signal is inputted to when a final scan signal is inputted, so minimum luminance increases. In particular, in case of the organic light emitting display device with high resolution, an increase in the number of scan lines leads to an increase in the minimum display time, which results in an increase in the minimum luminance.

SUMMARY

In one aspect, a method of driving an organic light emitting display device includes receiving an image signal by sub-field with respect to a single frame comprising the N number of sub-fields (N is a natural number greater than 2) from the exterior; dividing a single sub-field into an address period and a display period and selectively calling a data signal of a single sub-field from the M number of sub-field memories (M is a natural number greater than 2); and applying the called data signal of the single sub-field to a sub-pixel.

In another aspect, an organic light emitting display device comprises a main memory unit that receives image signals by sub-fields with respect to a single frame comprising the N number of sub-fields from the exterior; a sub-field memory unit that comprises the M number of sub-field memories that divide a single sub-field into an address period and a display period and selectively call a data signal of the single sub-field; and a sub-pixel that is illuminated upon receiving the called data signal of the single sub-field.

DESCRIPTION

Hereinafter, an implementation of this document will be described in detail Referring to the attached drawings.

[Embodiment 1]

Figure 1:
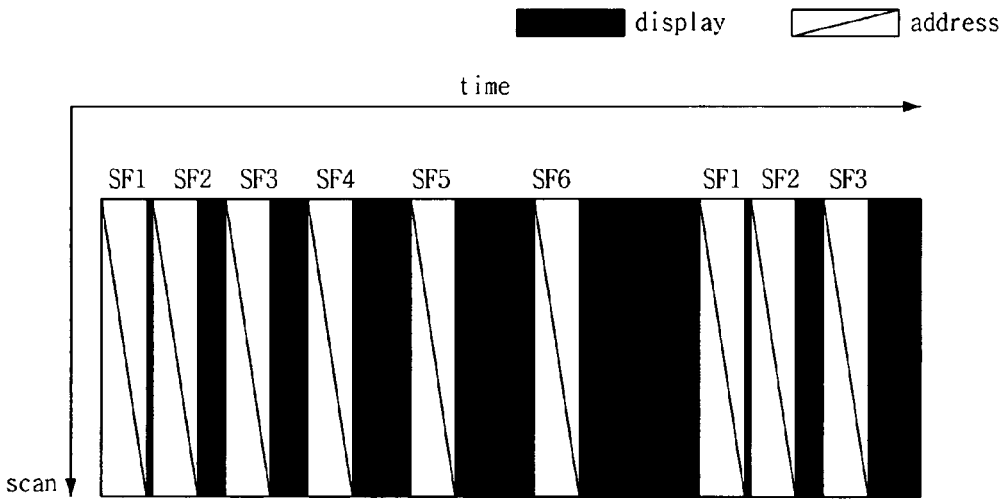
FIG.1 (Related Art)
FIG. 1 is a view illustrating the frame structure of a digitally driven organic light emitting display device according to the related art.
Figure 2:
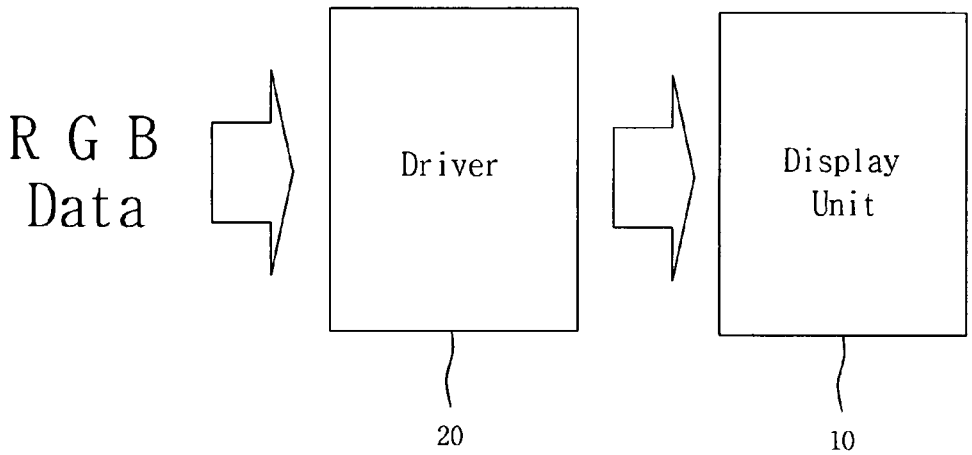
FIG. 2 is a schematic block diagram illustrating an organic light emitting display device according to a first embodiment of the present invention.

FIG. 2 is a schematic block diagram illustrating an organic light emitting display device according to a first embodiment of the present invention.

Referring to FIG. 2, the organic light emitting display device comprises a display unit 10 and a driver 20 that drives the display unit 10 upon receiving RGB data from the exterior.

The display unit 10 comprises a plurality of sub-pixels positioned at crossings of scan lines and data lines. A sub-pixel 11 may comprise a diode that comprises a first electrode, an organic light emission layer, and a second electrode. In the display device according to the first embodiment of the present invention, the display unit 10 comprises unit pixels of 240×320.

Figure 3:
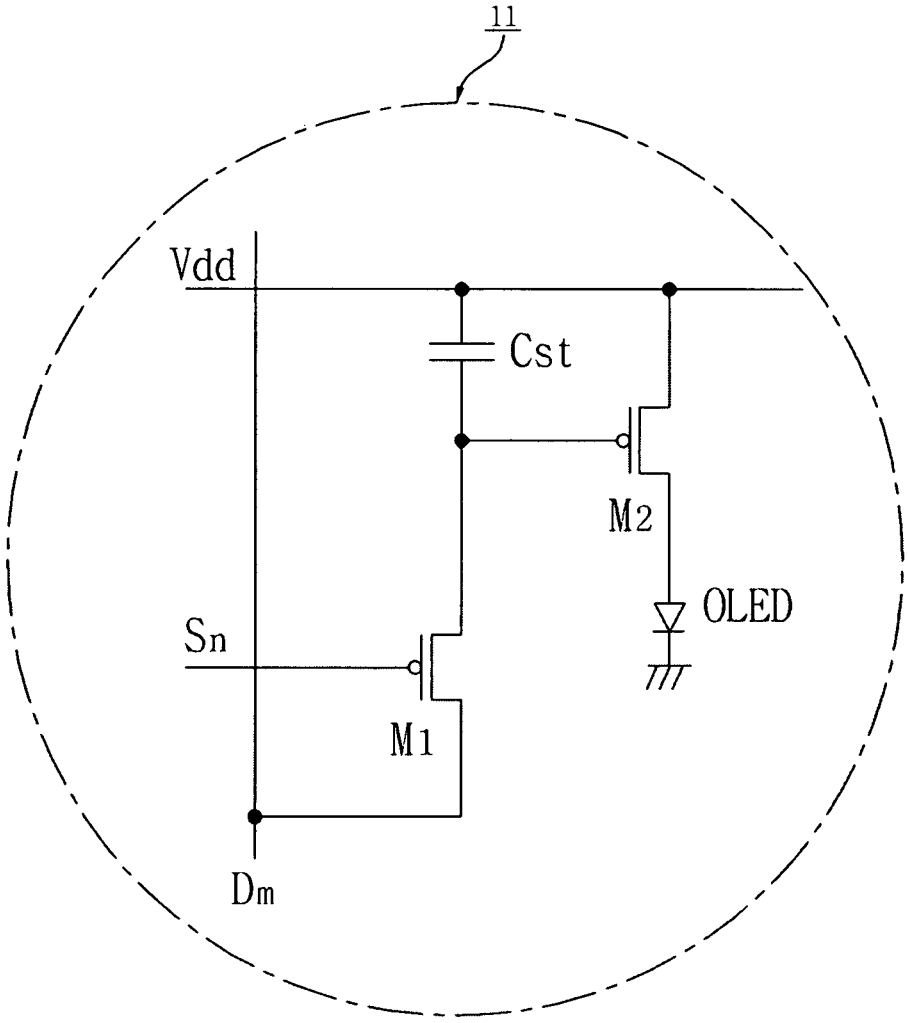
FIG. 3 is an equivalent circuit diagram of a sub-pixel in FIG. 2.

FIG. 3 is an equivalent circuit diagram of the sub-pixel in FIG. 2.

The sub-pixel 11 comprises first and second thin film transistors (TFTs) M1 and M2, p-type MOS transistors, which are turned on when a negative polarity signal is applied to their gate electrodes, and a capacitor Cst.

The first TFT M1 transfers a data signal inputted through a data line Dm according to a scan signal applied through a scan line Sn. The capacitor Cst stores the inputted data. The second TFT M2 is turned on or off according to the inputted data signal to supply current to an OLED.

The operation of the sub-pixel 11 of the organic light emitting display device constructed as described above will now be explained in detail. When the first TFT M1 is turned on by a select signal applied to its gate electrode, the data signal is transferred through the data line Dm. The data signal is stored in the capacitor Cst and the stored data signal is applied to the gate electrode of the second TFT M2. The second TFT M2 generates current corresponding to a difference between the data signal applied to its gate electrode and voltage connected with its source electrode and provides the current to the OLED. Then, the OLED generates a corresponding current.

Figure 4:
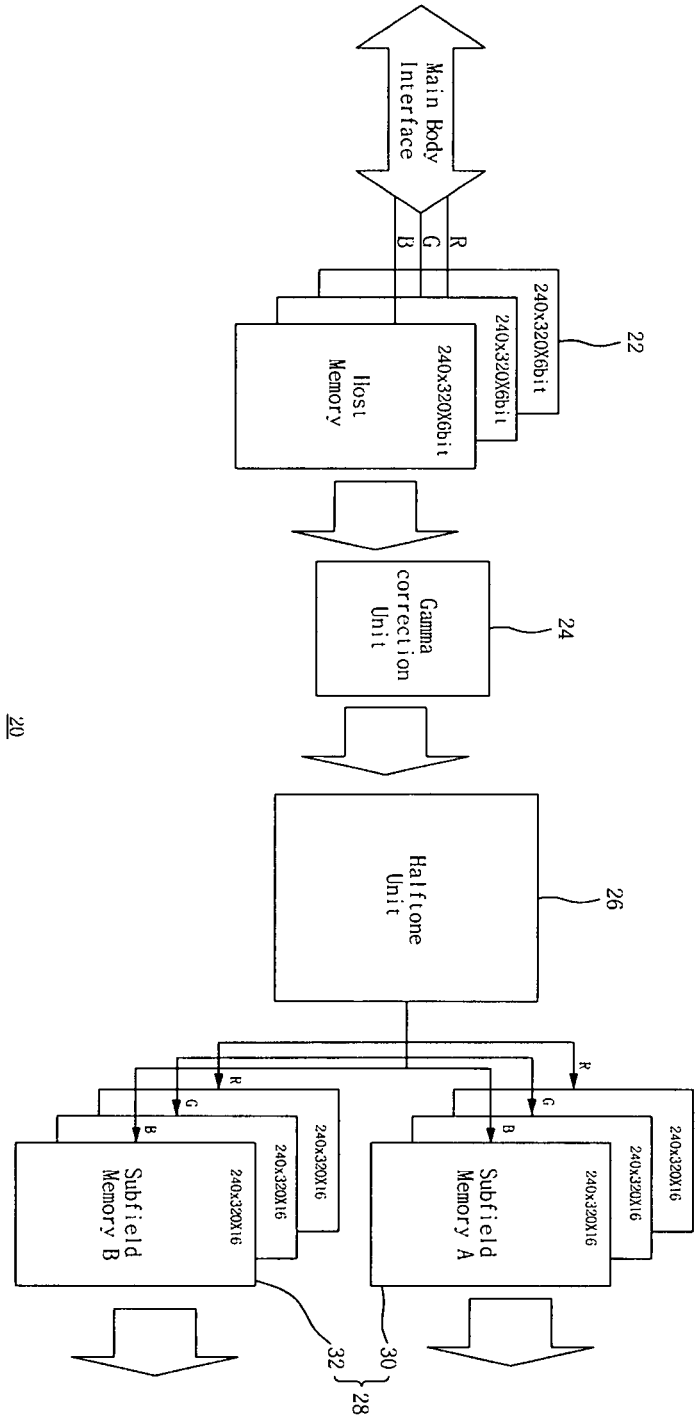
FIG. 4 is a schematic block diagram illustrating a driver of the organic light emitting display device according to the first embodiment of the present invention.

FIG. 4 is a schematic block diagram illustrating a driver of the organic light emitting display device according to the first embodiment of the present invention Referring to FIG. 4, the driver 20 of the organic light emitting display device according to the first embodiment of the present invention comprises a host memory unit 22 of 1.38 Mbit, a gamma correction unit 24, a half-tone unit 26, a sub-field memory unit 28, and a digital-to-analog converter (DAC) (not shown).

The host memory unit 22 receives RGB data from a main body interface and transmits image data to the gamma correction unit 24. In this case, in the driver 20, each unit pixel of 240×320 comprises RGB sub-pixels and a single sub-pixel comprises six sub-fields, so the main memory unit 22 comprises 1.38 Mbit (=240×320×3(RGB)×6).

The gamma correction unit 24 gamma-corrects the image data. The gamma correction unit 22 provides a gamma value according to luminance characteristics of the organic light emitting display device to a data driver.

The half-tone unit 26 half-tones the gamma-corrected image data by using one of truncation, a random E/D, a normal E/D and a Dither. As mentioned above with respect to the related art, in the digital driving method, gray levels that may be represented may differ according to the number of sub-fields, and currently, six sub-fields are used at 60 Hz.

The number of real gray levels that may be represented by using the six sub-fields is $2^6$=64. A sub-field may be expressed by a mapping therefore 64 mappings of the binary number exist. In this respect, however, due to a problem of a false contour, all the gray levels cannot be used but only some gray levels are selectively used and other gray levels are generated by the half-tone unit 26.

The half-tone unit 26 creates multiple in-between gray levels with the selected gray levels by using one of the truncation, the random E/D, the normal E/D, and the Dither, and uses them. In other words, a certain number of mappings that allow changes of optical axes to continue the most smoothly are selected to use as real gray levels, and the half-tone unit 26 generates multiple in-between gray levels as required with the selected gray levels through half-toning.

The sub-field memory unit 28 comprises a sub-field memory A 30 and a sub-field memory B 32 each having 7.37 Mbit (=240×320×3(RGB)×16(sub-fields)).

In order to remove the false contour and improve gray linearity, respective sub-fields should be disposed to have a step as small as possible therebetween. Thus, for this purpose, the sub-field memory A 30 and the sub-field memory B 32 use 16 sub-fields. (The number of sub-fields that are used may exceed 16.)

The sub-field memory A 30 selects a sufficient number of real gray levels. The sub-field memory A 30 calculates a gravity center to create a sub-field code. This basic mapping code is called a mapping table A and used as a sub-field code applied for a still image.

Because the sub-field memory A 30 has the sufficient number of real gray levels, it may well express a still image with a half-tone noise.

The sub-field memory B 32 creates a second mapping table in which all the remaining sub-fields except for a maximum (the highest) sub-field of the mapping table A, namely, which are lower than the maximum sub-field, are turned on, and uses it as a false contour buffering mapping table B. In this case, because the sub-field memory 32 uses the mapping table B in which the sub-fields lower than the maximum sub-field are turned on as the buffering table, gray levels of a finally created mapping code are slightly degraded compared with the previous one.

In case of a moving image (or moving picture, video), the sub-field memory unit 28 may use an AB alternating method, namely, both mapping codes of the sub-field memory A 30 and the sub-field memory B 32, to increase the probability that the sub-fields generating the false contour are turned on to distributively cancel out the positions of the false contour, thus obtaining the effects of restraining the false contour.

In the first embodiment, because the mapping with multiple real gray levels is used, a sharp still image may be obtained. In case of the moving image, because the probability of illumination of the sub-fields increases by using the buffering sub-fields, the false contour may be reduced.

If the false contour is intended to be restrained as much as possible, another mapping table may be additionally created in which the buffering sub-fields are larger than the previous one. By using the two buffering sub-fields, mutual values of the false contour may be canceled out to create the required gray levels.

The thusly modulated data is transferred to the D/A converter, which is converted into an analog signal by the D/A converter, which is then supplied to the display unit. The display unit displays a corresponding image.

[Embodiment 2]

Figure 5:
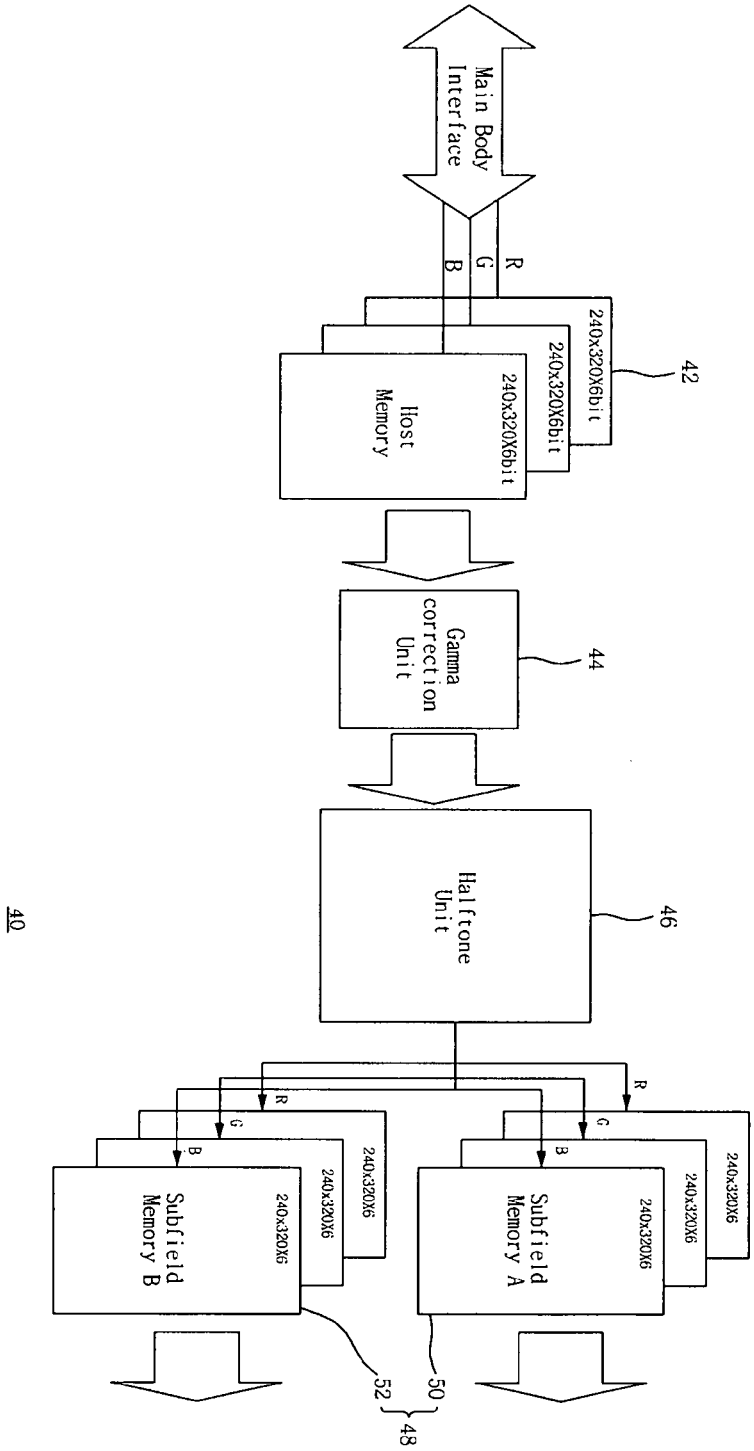
FIG. 5 is a schematic block diagram illustrating a driver of the organic light emitting display device according to a second embodiment of the present invention.

FIG. 5 is a schematic block diagram illustrating a driver of the organic light emitting display device according to a second embodiment of the present invention.

Referring to FIG. 5, a driver 40 of the organic light emitting display device according to the second embodiment of the present invention has the same structure as that of the first embodiment of the present invention as discussed above in that the driver 40 comprises a host memory unit 42 of 1.38 Mbit (=240×320×3(RGB)×6), a gamma correction unit 44 that gamma-corrects image data, and a half-tone unit 46 that half-tones the gamma-corrected image data by using one of truncation, a random E/D, a normal E/D, and a Dither, so its detailed description will be omitted.

A sub-field memory unit 48 is different from the sub-field memory unit 28 of the first embodiment of the present invention in that the sub-field memory unit 48 comprises a sub-field memory A 50 and a sub-field memory B 52 each having 240×320×3(RGB)×6(sub-fields) while the sub-field memory unit 28 comprises the sub-field memories of 240×320×3(RGB)×16(sub-fields). Consequently, the sub-field memory unit 48 has a memory capacity reduced to ⅓ of that of the sub-field memory unit 28 in the first embodiment of the present invention, while having the same picture quality. The reduction in the memory capacity may lead to a reduction of a size of a die of wafer, so the production yield may be enhanced.

The sub-field memory A 50 may express a still image by selecting a sufficient number of real gray levels while the sub-field memory B 52 uses the false contour buffering mapping table B in which the sub-fields lower than the maximum sub-field, excluding the maximum sub-field, are turned on, likewise as in the first embodiment of the present invention.

Thus, in case of a moving image, the sub-field memory unit 48 uses the AB alternating method, namely, alternately uses the both mapping codes of the sub-field memory A 50 and the sub-field memory B 52. In addition, in order to maximize the effects of restraining the false contour, another mapping table may be additionally created in which the buffering sub-fields are larger than those of the related art, and used.

Figure 6:
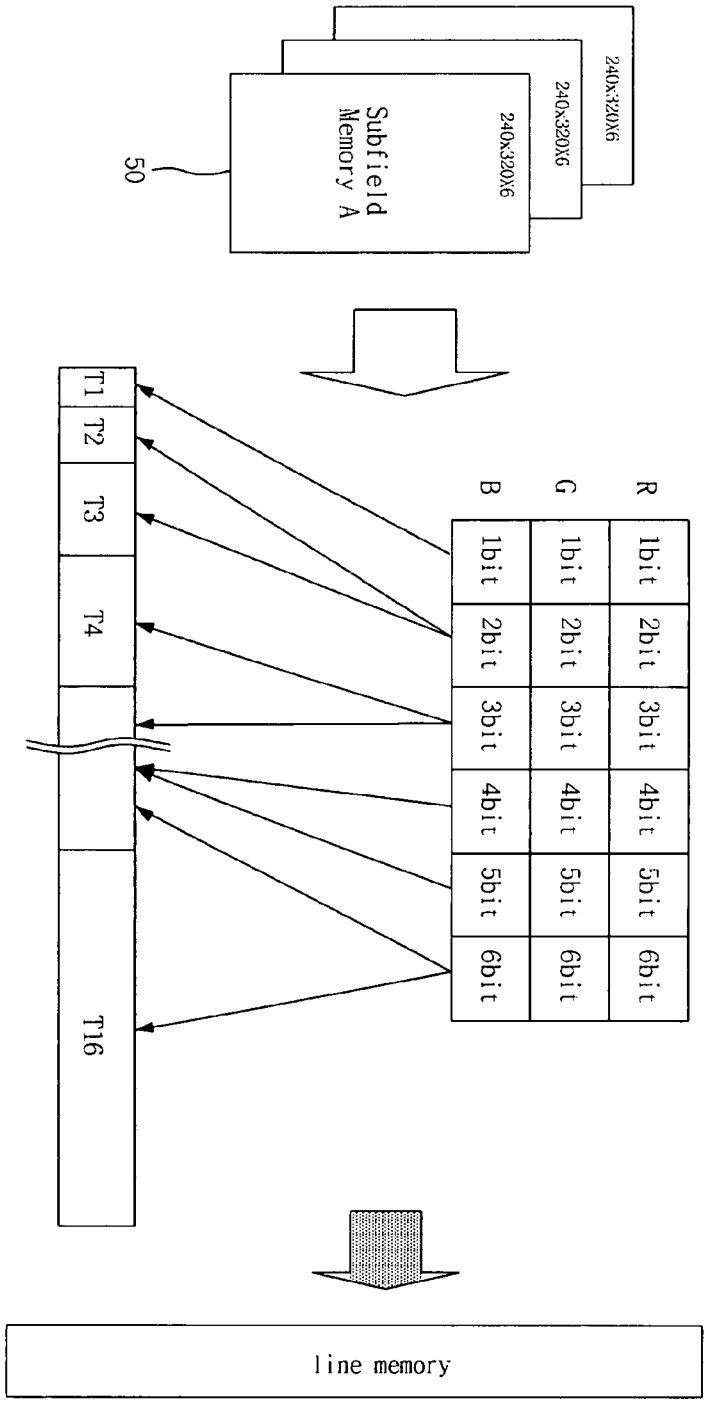
FIG. 6 is a conceptual view of a driving method of the driver of the organic light emitting display device according to the second embodiment of the present invention.

FIG. 6 is a conceptual view of a driving method of the driver of the organic light emitting display device according to the second embodiment of the present invention.

Referring to FIG. 6, the driver of the organic light emitting display device according to the second embodiment of the present invention employs a time-to-bit mapping method in order to obtain the same picture quality as that of the organic light emitting display device according to the first embodiment of the present invention, while reducing the memory capacity of the memory unit 48 by one-third. This driving method is a method extending from a bit mapping split method, whereby the false contour problematic in the digital driving may be reduced.

Of the sub-field memory unit 48, the sub-field memory A 50 and the sub field memory B 52, each having 240×320×3(RGB)×6(sub-field), use 6 bits by dividing them into 16 sub-fields, so when each sub-field is called, bit data is called from each memory.

As shown in FIG. 6, in the sub-field memory A 50 and the sub-field memory B 52, sub-field #1 is allocated to 1 bit, sub-fields #2 and #3 are allocated to 2 bits, . . . , and sub-fields #13, #14, #15, and #16 are allocated to 6 bits, so as to be used.

In this driving method, which sub-fields and how many sub-fields are allocated to bits of the sub-field memory A 50 and the sub-field memory B 52 may be arbitrarily varied depending on picture quality.

Figure 7:
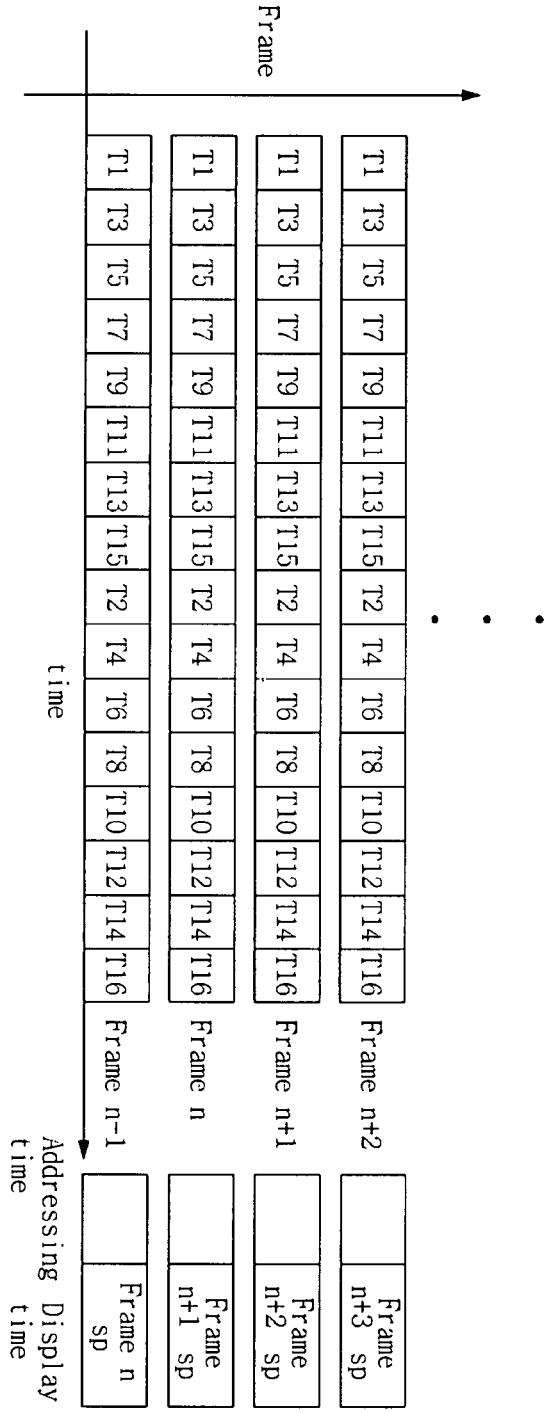
FIG. 7 is a view illustrating the structure of sub-fields of the organic light emitting display device according to the second embodiment of the present invention.

FIG. 7 is a view illustrating the structure of sub-fields of the organic light emitting display device according to the second embodiment of the present invention.

Referring to FIG. 7, in the organic light emitting display device according to the second embodiment of the present invention, sub-fields are divided into two groups and their bit values are called according to the order of the sub-fields.

The reason for dividing the sub-fields into two groups is to prevent flickering of the sub-fields. The groups of sub-fields may be arbitrarily divided in mapping them.

T16 is fixedly used for an SP (scan pulse). T16 comprises an addressing time and a display time. The SP proceeds in the display time of the T16. The display time is formed in consideration of a delay time of the SP.

As stated above Referring to FIGS. 6 and 7, the driver of the organic light emitting display device according to the second embodiment of the present invention has the advantages that the sub-field memory capacity may be reduced and the sub-fields may arbitrarily extend and be varied in disposition. In addition, this driving method does not need such a sub-field mapping table.

The embodiments of the present invention have been described referring to the drawings but the present invention is not limited thereto.

The above-described embodiments exemplarily describes the organic light emitting display device, but without being limited thereto, the present invention may be also applied for any display device such as an inorganic light emitting display device or the like.

In the organic light emitting display device according to the above-described embodiments, the sub-pixels comprise two transistors and one capacitor, but without being limited thereto, the sub-pixels may comprise a different number of transistors and capacitors.

In the above-described embodiments, the driver comprises the gamma correction unit and the half-tone unit, but if the driver may be driven without them, the gamma correction unit and the half-tone unit may be omitted.

In the above-described embodiments, one frame is divided into 6 sub-fields and 16 sub-fields, but the number of sub-fields may be arbitrarily determined in consideration of resolution and luminance.

The present invention constructed as described above has the following advantages.

First, the picture quality may be improved by employing the time-to-bit mapping method, while reducing the sub-field memory capacity and freely extending the sub-fields.

Second, the sub-fields may be arbitrarily (freely) disposed, and because the sub-fields may be divided by two or more groups, generation of false contour or flicking may be prevented.

The foregoing description of the preferred embodiments of the present invention has been presented for the purpose of illustration and description, and it is not intended to be exhaustive or to limit the invention to the precise form disclosed, and modifications and variations are possible in light of the above teachings or may be acquired from practice of the invention. Thus, it is to be understood that the invention is not limited to the disclosed embodiments, but, on the contrary, is intended to cover various modifications and equivalent arrangements included within the spirit and scope of the appended claims.

What is claimed is:

1. A method of driving an organic light emitting display device having a plurality of sub-pixels, the method comprising:

receiving image signals by sub-fields with respect to a single frame comprising the N number of sub-fields per sub-pixel (N is a natural number greater than 2) from the exterior;

selecting fewer than all of real gray levels represented by the N sub-fields;

half-toning the selected real gray levels to generate a plurality of in-between gray levels, different from the real gray levels;

storing, in a first sub-field memory among an M number of sub-field memories, the selected real gray levels and the in-between gray levels;

dividing a single sub-field into an address period and a display period and selectively calling a data signal of the single sub-field from the M number of sub-field memories (M is a natural number greater than 1), a data signal being stored in a capacitor of a sub-pixel during the address period, an organic light emitting diode of the sub-pixel being illuminated during the address period and the display period; and applying the called data signal of the single sub-field to the sub-pixel, wherein the sub-field memories include the first sub-field memory and a second sub-field memory, wherein the first sub-field memory creates a first sub-field mapping code table of the sub-fields to express real gray levels of a still image by a combination of the N number of sub-fields, and wherein the second sub-field memory creates a second sub-field mapping code table in which all the remaining sub-fields except for a maximum sub-field of the first sub-field memory to express gray levels lower than the gray levels expressed by the first sub-field memory, a display period of the maximum sub-field having a maximum binary weight.

2. The method of claim 1, further comprising gamma-correcting the image signals.

3. The method of claim 1, wherein:

N is 6 or 16; and

M is 2.

4. The method of claim 1, wherein some of the sub-fields are divided into multiple groups and data signals with respect to the sub-fields are called from the sub-field memories.

5. The method of claim 4, wherein the same M number of sub-field memories that call one or more data signals of the N number of sub-fields are changeable.

6. The method of claim 1, further comprising creating a third sub-field mapping code table having buffering sub-fields larger than buffering sub-fields of the first and second sub-field mapping code tables.

7. An organic light emitting display device, comprising:

a main memory that receives image signals by sub-fields with respect to a single frame comprising the N number of sub-fields per sub-pixel from the exterior;

a half-tone circuit configured to select fewer than all of real gray levels represented by the N sub-fields and to half-tone the selected real gray levels to generate a plurality of in-between gray levels, different from the real gray levels; and a sub-field memory unit that comprises an M number of sub-field memories that divide a single sub-field into an address period and a display period and selectively call a data signal of the single sub-field, a data signal being stored in a capacitor of a sub-pixel during the address period, an organic light emitting diode of the sub-pixel being illuminated during the address period and the display period;

wherein the sub-field memories include a first sub-field memory configured to store the selected real gray levels and the in-between gray levels and a second sub-field memory, wherein the first sub-field memory creates a first sub-field mapping code table of the sub-fields to express real gray levels of a still image by a combination of the N number of sub-fields, wherein the second sub-field memory creates a second sub-field mapping code table in which all the remaining sub-fields except for a maximum sub-field of the first sub-field memory to express gray levels lower than the gray levels expressed by the first sub-field memory, a display period of the maximum sub-field has a maximum binary weight.

8. The device of claim 7, further comprising a gamma correction circuit that gamma-corrects the image signals.

9. The device of claim 7, wherein:

N is 6 or 16; and

M is 2.

10. The device of claim 7, wherein some of the sub-fields are divided into multiple groups and a data signal with respect to the sub-fields is called from the sub-field memories.

11. The device of claim 10, wherein the same M number of sub-field memories that call one or more data signals of the N number of sub-fields are changeable.

12. The device of claim 7, wherein the sub-field memory unit creates a third sub-field mapping code table having buffering sub-fields larger than buffering sub-fields of the first and second sub-field mapping code tables.

13. An organic light emitting display device, comprising:

a display unit comprising a plurality of sub-pixels;

a host memory comprising an N number of bits representing an N number of sub-fields for each sub-pixel, the host memory being configured to receive an image data from an external source, where N is a natural number greater than 2;

a half-tone circuit configured to:

select fewer than a $2^N$ number of real gray levels represented by the N sub-fields; and half-tone the selected real gray levels to generate a plurality of in-between gray levels different from the real gray levels;

a sub-field memory unit including a first sub-field memory and a second sub-field memory, the sub-field memory unit being configured to store the selected real gray levels and the in-between gray levels in a P number of sub-fields for each sub-pixel, where P is a natural number greater than N; and a digital-to-analog converter configured to convert data from the sub-field memory unit into an analog signal supplied to the display unit.

14. The device of claim 13, wherein the first sub-field memory is configured to create a first sub-field mapping table using the selected real gray levels and the in-between gray levels to express a still image.

15. The device of claim 14, wherein the second sub-field memory is configured to:

create a second sub-field mapping table with all of the sub-fields except for a maximum sub-field of the first mapping table; and use the second sub-field mapping table as a false contour buffering mapping table.

16. The device of claim 15, wherein the sub-field memory unit is further configured to create a third sub-field mapping code table having buffering sub-fields larger than buffering sub-fields of the second sub-field mapping code table.

17. The device of claim 13, wherein the first sub-field memory and the second sub-field memory each have a P number of bits to represent the P number of sub-fields for each sub-pixel.

18. The device of claim 13, wherein:

the first sub-field memory and the second sub-field memory each have an N number of bits for each sub-pixel; and the first sub-field memory and the second sub-field memory are configured to divide the N bits into the P number of sub-fields.

19. The device of claim 18, wherein, when one of the sub-fields is called, bit data is called from each of the first sub-field memory and the second sub-field memory.

20. The device of claim 13, further comprising a gamma correction circuit configured to gamma-correct the image data.

* * * * *